United States Patent [19]

Saito et al.

[11] 4,333,804

[45] Jun. 8, 1982

[54] METHOD OF PREVENTING DETERIORATION OF PALLADIUM OXIDE ANODE

[75] Inventors: Kohji Saito; Hidenori Shibata, both of Chiba, Japan

[73] Assignee: Asahi Glass Company, Ltd., Tokyo, Japan

[21] Appl. No.: 226,903

[22] Filed: Jan. 21, 1981

[30] Foreign Application Priority Data

Jan. 22, 1980 [JP] Japan ..... 55/5231

[51] Int. Cl.[3] ..... C25B 1/34

[52] U.S. Cl. ..... 204/98; 204/128; 204/290 F

[58] Field of Search ..... 204/98, 128, 290 F

[56] References Cited

U.S. PATENT DOCUMENTS 4,233,340 11/1980 Saito et al. ..... 204/290 F

*Primary Examiner*—R. L. Andrews

*Attorney, Agent, or Firm*—Oblon, Fisher, Spivak, McClelland & Maier

[57] ABSTRACT

The deterioration of a palladium oxide type anode caused by stopping the operation of a diaphragm type electrolytic cell in the electrolysis of an alkali metal chloride is prevented by increasing the concentration of hypochlorite ions in the anolyte to give a predominant anode potential in short circuit state higher than the reduction potential of palladium oxide.

9 Claims, 3 Drawing Figures

METHOD OF PREVENTING DETERIORATION OF PALLADIUM OXIDE ANODE

BACKGROUND OF THE INVENTION

1. Field of the Invention

The present invention relates to a method of preventing deterioration of a palladium oxide type anode. More particularly, it relates to an improvement of durability of a palladium oxide type anode by preventing weight loss of palladium oxide caused by actuating a jumping switch (by-pass) for stopping the operation of a diaphragm type alkali metal chloride electrolytic cell equipped with a palladium oxide type anode.

2. Description of the Prior Arts

Electrodes having a surface layer comprising a metal oxide as a platinum group metal oxide have been proposed as anodes of the alkali metal chloride electrolytic cell for producing chlorine in anode compartment and an alkali metal hydroxide in a cathode compartment by an electrolysis of an aqueous solution of an alkali metal chloride to obtain dimensional stability for long period and low overvoltage of the anode. Among them, an anode made of a valve metal substrate coated with ruthenium oxide has been practically used in view of excellent characteristics in U.S. Pat. No. 3,711,385 and No. 3,864,163.

Recently, an electrode having the surface coated with palladium oxide among the platinum group metal oxides has been proposed as an excellent anode with high oxygen overvoltage for producing chlorine having high purity in the anode compartment and low chlorine overvoltage as disclosed in Japanese Unexamined Patent Publication No. 35277/1974, No. 43879/1979 and No. 77286/1979.

On the other hand, when an electrolysis of an aqueous solution of an alkali metal chloride is carried out in a diaphragm type alkali metal chloride electrolytic cell equipped with a porous diaphragm or a cation exchange membrane (as diaphragm) it is necessary to stop the operation of the diaphragm type electrolytic cell because of an exchange of the diaphragm due to durability of the porous diaphragm and the cation exchange membrane, or accidental trouble. The electrolysis can be continued without stopping the operation of the entire electrolyzing plant, but only by connecting the jumping switch C to both terminals of an electric circuit of an electrolytic cell for dominant state (electrolytic cell $A_2$ in the drawings) as shown in FIGS. 1, 2 and 3.

When the operation of the electrolytic cell is temporarily stopped by the jumping switch for the electrolytic cell, and the operation is restarted after the exchange of the diaphragm in an electrolytic cell equipped with the electrode coated with a surface layer made of palladium oxide as the anode, it has been found that the chlorine overvoltage of the anode and the cell voltage rise higher than the voltages before the stop of the operation of the electrolytic cell and the economical operation of the electrolytic cell can not continue in a practical operation for ten to several hundreds hours after the restart of the operation. The electrodes made of such platinum group metal oxide should be usually used for 3 to 5 years whereas the durability of the diaphragm is usually only for 1 to 2 years. Therefore, such problem is a fatal disadvantage for the electrode used in the industrial operation.

The jumping switch is also used as a switch which bypasses the electrical current around each incapaciated cell to the two adjacent cells in a plant, thus allowing steady operation of the cell circuit without any interruptions due to the incapacity of a cell.

SUMMARY OF THE INVENTION

It is an object of the present invention to provide a method of preventing deterioration of a palladium oxide type anode and improving durability of the anode.

The foregoing and other objects of the present invention have been attained by preventing deterioration of a palladium oxide type anode which is caused by using a jumping switch to stop the operation of the diaphragm type electrolytic cell for electrolysis of an alkali metal chloride by increasing the concentration of hypochlorite ions in an anolyte to give a predominant anode potential in shortcircuit state higher than the reduction potential of palladium oxide.

DETAILED DESCRIPTION OF THE PREFERRED EMBODIMENTS

When the electrolysis of an aqueous solution of an alkali metal chloride is carried out in an electrolytic cell, a small amount of hypochlorite ions remains in the aqueous solution of an alkali metal chloride as the anolyte since it is produced by a reaction of chlorine gas generated on the anode with water or a reaction of chlorine gas with an alkali metal hydroxide reversely diffused through the diaphragm into the anode compartment. However, the concentration of hypochlorite remaining in the electrolysis is not high enough as shown in the following comparison.

In accordance with the present invention, hypochlorite ions are preferably fed into the anolyte to increase the concentration of hypochlorite ions for providing predominant anode potential in the shortcircuit state higher than the specific reduction potential of palladium oxide. The specific reduction potential of palladium oxide depends upon the condition for the electrolysis. It has been found that the concentration of hypochlorite ions in the anolyte is preferably higher than 1.0 g./l. especially higher than 2.0 g./l. to attain excellent effect for preventing deterioration of palladium oxide.

The mechanism for preventing such deterioration of the palladium oxide type anode by the incorporation of hypochlorite ions in the anolyte has not been clearly understood, but can be considered as follows. The consideration is, however, provided for purposes of illustration only and is not intended to be limiting the present invention.

Figure 1:
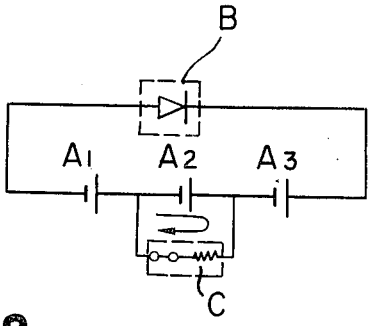
FIGS. 1, 2 and 3 show electrolyzing plants equipped with monopolar electrolytic cells or bipolar electrolytic cells for electrolyzing an alkali metal chloride according to the present invention.
Figure 2:
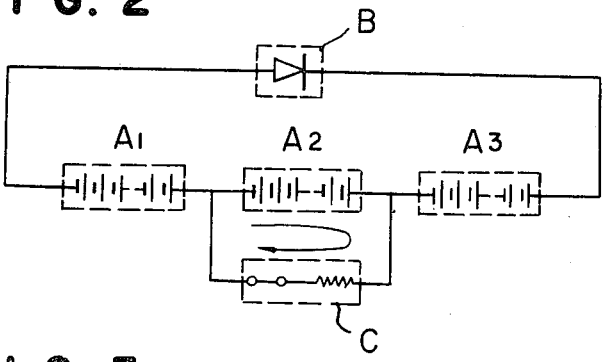
Figure 3:
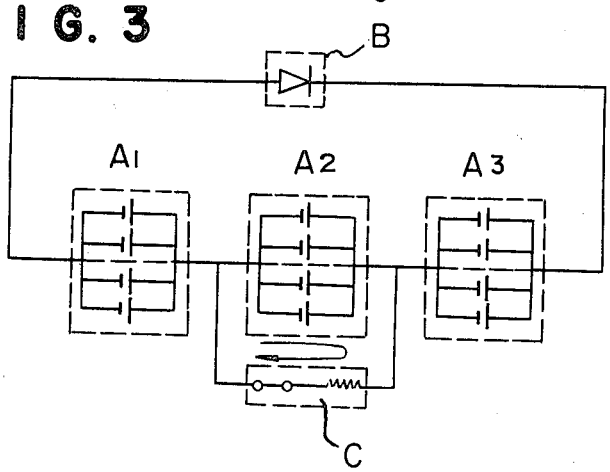

When the operation of the diaphragm type electrolytic cell for electrolysis of an alkali metal chloride is stopped by actuating the jumping switch, the current fed to the electrolytic cell is stopped at the moment for actuating the jumping switch in the electric circuit. At this moment, a kind of oxidation-reduction cell is formed in the electric cell to cause electromotive force whereby the reverse current shown by the arrow lines in FIGS. 1 to 3 is fed. The reduction of palladium oxide is caused on the anode by the reverse current and the dissolution of the metal for the cathode is caused on the cathode. Thus, palladium oxide on the surface of the anode is converted into metallic palladium which has high chlorine overvoltage. If the operation of the electrolytic cell is restarted from such condition, the anode potential is increased. On the other hand, when the concentration of hypochlorite in the anolyte is higher than the specific concentration in accordance with the present invention, the reduction of hypochlorite is caused instead of the reduction of palladium oxide whereby the deterioration of palladium oxide on the anode can be prevented.

The method of the present invention will be further described in detail. The palladium oxide type anode used in the present invention means an electrode having, on the surface, palladium oxide layer which imparts the effect as anodic active substance in the electrolysis of an alkali metal chloride. The electrode preferably has a surface layer comprising more than 5 mol %, especially more than 30 mol % of palladium oxide and has a substrate made of a valve metal such as titanium, niobium, tantalum and zirconium, especially titanium. Sometimes, it is preferable to form the surface layer by the combination of the other metal or metal oxide with palladium oxide, for example, the surface layer comprising 5 to 99 mol %, especially 30 to 70 mol % of palladium oxide, and 1 to 95 mol %, especially 70 to 30 mol % of the platinum group metal. Various embodiments can be considered for coating the layer comprising palladium oxide as the main component on the electroconductive substrate. For example, Pt-Pd alloy is coated on the electroconductive substrate and is oxidized by an anodic oxidation to form oxides of the alloy. A palladium oxide precursor for forming palladium oxide by a thermal decomposition such as palladium chloride is coated on the electroconductive substrate and is heat-treated. A palladium oxide powder is coated and heat-treated to bond it on the substrate. In view of corrosion resistance of the layer in the electrolysis, it is preferable to form it by blending a palladium oxide powder to a precursor for producing metallic platinum by a thermal decomposition such as chloroplatinic acid, and dispersing the mixture in a liquid such as butanol, if necessary with a dispersing agent, to prepare a coating composition and coating the composition on a substrate and baking it. It is further preferable to form it by preparing the coating composition containing a precursor for producing metallic platinum by the thermal decomposition such as chloroplatinic acid and bromoplatinic acid and coating the composition and baking it and then coating the above-mentioned coating composition. The optimum result can be obtained by coating the above-mentioned coating composition and the coating solution of chloroplatinic acid, on the electroconductive substrate and heat-treating them by repeating at least two times the coating and the heat-treatment. It is possible to disperse or to dissolve an oxide or a precursor for producing an oxide by a thermal decomposition in the above-mentioned coating composition and/or the solution of chloroplatinic acid so as to increase the mechanical strength of the coated layer. The oxides or the precursors can be oxides, halides especially chloride, sulfates, nitrates and alkyl compounds of Ce, Zr, Sn, Sb, Ti, Ta, W, Si, Pb, alkali metals and alkaline earth metals.

It is preferable to give each concentration of 0.01 to 10 g./ml. as the metal in the coating composition and the solution of chloroplatinic acid, respectively. The medium or solvent used for them is preferably water, ethanol, propanol, butanol or a mixture thereof. The coating composition is usually coated by a brushing or spraying and is heat-treated in each coating to bake the coating composition. The baking is usually carried out under an oxygen partial pressure of 0.002 to 5 atm. at 300° to 800° C. for 5 minutes to 1 hour. The baking for the lower layer is preferably carried out at 300° to 800° C. for 5 minutes to 10 minutes and the baking for the upper layer is preferably carried out at 300° to 800° C. for 10 minutes to 1 hour. The coated layer preferably has a thickness of about 0.5 to 10$\mu$. The shape and size of the anode can be selected as desired.

Both of the diaphragm type electrolytic cell using a porous diaphragm for permeating an alkali metal chloride or the ion exchange membrane type electrolytic cell using a cation exchange membrane, can be used as the diaphragm type electrolytic cell for electrolysis of an alkali metal chloride as far as the palladium oxide type anode is equipped.

The diaphragms used in the diaphragm type electrolytic cell include porous diaphragms such as asbestos diaphragm, fluorinated resin diaphragms, asbestos diaphragm reinforced by a fluorinated resin and others and also ion exchange membranes such as fluorinated resin type ion exchange membranes having sulfonic acid group, carboxylic acid group, phosphoric acid group or phenolic hydroxyl group as the ion exchange group.

The cathode equipped with the electrolytic cell can be the electrode made of iron, nickel, stainless steel, Raney nickel and developed Raney nickel.

In accordance with the findings, the deterioration of palladium oxide caused by the stop of the operation of the electrolytic cell by the jumping switch for the electrolytic cells, is increased depending upon the increase of the concentration of hydrogen ions of the anolyte in the cell that is of lower pH. On the other hand, pH of the anolyte in the electrolysis of an alkali metal chloride is in a range of 3.5–4.5 in the porous diaphragm process and in a range of 2.0 to 4.0 in the ion exchange membrane process. In the ion exchange membrane process, it has been considered to be preferably lower pH of the anolyte in view of higher purity of chlorine generated on the anode. In accordance with the process of the present invention, the deterioration of palladium oxide can be prevented regardless of pH of the anolyte and accordingly, the advantage of the present invention is remarkable.

In accordance with the method of the present invention, the concentration of hypochlorite ions ($ClO^-$) in the aqueous solution of an alkali metal chloride in the anode compartment of the electrolytic cell is increased preferably by adding a hypochlorite ion compound to the solution for the temporary stop of the operation of the electrolytic cell. The hypochlorite ion compound used in the method of the invention can be an aqueous solution of hypochlorous acid and also can be a precursor for forming hypochlorite ions by decomposition in an anolyte such as alkali metal hypochlorite and alkaline earth hypochlorites (such as bleaching powder) and also can be a precursor for forming hypochlorite ions by reaction with chlorine in the anolyte, such as alkali metal hydroxides and alkaline earth metal hydroxides.

The concentration of hypochlorite ions is increased by the addition of the hypochlorite ion compound to the anolyte. The concentration of hypochlorite ions is preferably in said range of higher than 1.0 g./l. and especially higher than 3.0 g./l. In view of the prevention of deterioration of palladium oxide, higher concentration of hypochlorite ions is more effective, however, if the concentration is too high, the resulting hypochlorous acid and chloric acid may cause corrosion and troubles at the restart of the operation of the electrolytic cell. Therefore, it is preferable to use a concentration of hypochlorite ions of less than 100 g./l. especially 30 g./l.

The addition of the hypochlorite ion compound to the anolyte can be intermittently or continuously carried out or carried out at a simple dosage. The addition of the hypochlorite ion compound can be carried out at the time or after the actuation of the jumping switch, and it is preferably carried out to give high concentration of hypochlorite ions in the anolyte before the actuation of the jumping switch.

It is also possible to increase the concentration of hypochlorite ions in the anolyte by modifying the condition of the operation of the electrolytic cell such as temporary decrease of current efficiency under increase of current density.

FIGS. 1 to 3 show the electrolyzing plant equipped with the electrolytic cells for electrolyzing an alkali metal chloride according to the present invention. In the drawings, the references $A_1$–$A_3$ respectively designate electrolytic cells; B designates a rectifier; C designates a jumping switch. FIGS. 1 and 3 show the plants equipped with the monopolar electrolytic cells and FIG. 2 shows the plant equipped with the biopolar electrolytic cell. In these plants, the electrolytic cells $A_1$–$A_3$ are respectively formed by a plurality of units of the cells. The jumping switch C is actuated by connecting to the electrolytic cell for dominant state (Cell $A_2$ in the drawing) as shown in the drawings. The jumping switch C can be any kind of a switch for interruption of current for electrolysis to the electrolytic cell for dominant state. The resistance of the jumping switch is preferably low in view of minimizing electric loss. It is not advantageous to increase the resistance of the jumping switch, though the deterioration of the anode can be reduced by the resistance.

It is preferable to give uniform concentration of hypochlorite ions in each of the electrolytic cell in the increase of the concentration of hypochlorite ions. In the case of the plant equipped with the bipolar electrolytic cells shown in FIG. 2, the effect for preventing the deterioration of the electrode is remarkably high. The deterioration of the palladium oxide type anode in the bipolar electrolytic cell is usually larger than that of the monopolar electrolytic cell. In accordance with the method of the present invention, the deterioration of the anode can be effectively prevented in both kinds of the electrolytic cells. The industrial advantages are remarkably high.

The present invention will be further illustrated by certain examples and references which are provided for purposes of illustration only and are not intended to be limiting the present invention.

EXAMPLE 1

Eleven monopolar porous diaphragm electrolytic cells were assembled by using each unit cell (effective current pass area of 1.5 $dm^2$) which was equipped with an expanded metal electrode having a titanium substrate coated with a surface layer made of 40 mol % of palladium oxide (PdO) and 60 mol % of platinum (Pt) as an anode, a mesh iron electrode as a cathode on which asbestos was deposited in a form of diaphragm. A rectifier (30 A:50 V) was connected to the electrolytic cells to prepare an electrolyzing plant. In each cell, an aqueous solution of sodium chloride (NaCl: 320 g./l.) was fed at a rate of 375 ml./hour and the electrolysis was carried out at 90° C. under the condition of a cell voltage of 3.55 V and a current density of 19.8 $A/dm^2$. The resulting catholyte (NaOH: 128 g./l. and NaCl: 206 g./l.) was continuously discharged.

The operation of one electrolytic cell in the electrolyzing plant was stopped by the jumping switch (knife switch: electric resistance of 0.01Ω) as shown in FIG. 1.

Before the actuation of the jumping switch, an aqueous solution of NaClO, an aqueous solution of NaOH, or an aqueous solution of HClO was added to give each concentration of $ClO^-$ in each anolyte as shown in Table 1, or no additive was added, or hydrochloric was added for comparison and pH of each anolyte, each potential of the palladium oxide anode and a reduction of palladium oxide at the shortcircuit in the electrolytic cell were measured. The results are shown in Table 1.

The potential of the anode was tested by the potential measurement to a saturated calomel electrode in a bridge with Luggin capillary.

The reduction of palladium oxide was observed by color of the anolyte after feeding current. The reduction of palladium oxide was also confirmed by measuring loss of thickness of each oxide coated layer on the anode by X-rays.

TABLE 1

| No. | Method | Anolyte at shortcircuit: Conc. of $ClO^-$ (g./l.) | Anolyte at shortcircuit: pH | Potential of anode at shortcircuit (V) vs S.C.E. | Reduction |
|---|---|---|---|---|---|
| 1 | 4% NaClO aq. feed | 0.9 | 4.5 | −0.20 | None |
| 2 | 9% NaClO aq. feed | 1.9 | 4.6 | 0 | " |
| 3 | 13% NaClO aq. feed | 3.2 | 5.1 | +0.05 | " |
| 4 | 10% NaOH aq. feed | 1.2 | 11.8 | −0.36 | " |
| 5 | 5% HClO aq. feed | 2.1 | 5.1 | 0 | " |
| 6 | 20% HCl feed | 0.1 | 1.1 | −0.50 | Reduction |
| 7 | None | 0.4 | 4.3 | −0.65 | Reduction |

Test No. 3 was carried out by adding NaClO aq. solution at the time actuating the jumping switch.

EXAMPLE 2

Three bipolar electrolytic cells were assembled by using each four unit cells (effective current pass area of 1.5 $dm^2$) which were respectively equipped with each anode having a titanium substrate coated with a surface layer made of 30 mol % of palladium oxide and 70 mol % of platinum and the same cathodes and the same diaphragm as those of Example 1 and a rectifier (30 A:150 V) was connected to prepare the electrolyzing plant shown in FIG. 2.

Each electrolysis of an aqueous solution of sodium chloride was carried out under the substantially same condition of the operation of the electrolytic cells as that of Example 1.

The operation of one electrolytic cell in the electrolyzing plant was stopped by the jumping switch (knife switch: electric resistance of 0.11Ω) as shown in FIG. 2, to shortcircuit the electrolytic cell.

As the method of Example 1, before the actuation of the jumping switch, an aqueous solution of NaClO, an aqueous solution of NaOH or an aqueous solution of HClO was continuously added to give each concentration of $ClO^-$ in each anolyte as shown in Table 2 and the jumping switch was actuated. The results are shown in Table 2 together with data for non-addition.

TABLE 2

| No. | Method | Anolyte at shortcircuit: Conc. of $ClO^-$ (g./l.) | Anolyte at shortcircuit: pH | Potential of anode at shortcircuit (V) vs S.C.E. | Reduction |
|---|---|---|---|---|---|
| 1 | 4% NaClO aq. feed | 8.5–11.0 | 4.6–4.9 | −0.05−−0.25 | None |
| 2 | 9% NaClO aq. feed | 2.8–3.3 | 4.6–4.7 | 0−−0.20 | " |
| 3 | 13% NaClO aq. feed | 5.1–6.1 | 4.5–4.8 | 0−−0.30 | " |
| 4 | 10% NaOH aq. feed | 1.9–2.5 | 10.5–11.5 | −0.2−−0.4 | " |
| 5 | None | 0.5–0.7 | 3.8–4.2 | −0.2−−0.85 | Reduction |

EXAMPLE 3

Eleven electrolytic cells were assembled by using each monopolar-ion exchange membrane electrolytic cell (effective current pass area of 1.5 $dm^2$: electrode gap of 2.2 cm) which was equipped with the same anode and the same cathode as those of Example 1 and a cation exchange membrane of a fluorinated resin obtained by hydrolyzing a copolymer of $C_2F_4$ and $CF_2{=}CFO(CF_2)_3COOCH_3$ (ion exchange capacity of 1.40 meq/g.: thickness of 100μ) and a rectifier (120 A:20 V) was connected to prepare the electrolyzing plant shown in FIG. 3.

An aqueous solution of sodium chloride (NaCl: 302 g./l.) was fed into an anode compartment at a rate of 330 ml./hour cell and water was fed into a cathode compartment to maintain a concentration of sodium hydroxide of 576 g./l. in an electrolysis under the condition of a current density of 17.5 A/$dm^2$, a cell voltage of 3.75 V and a temperature of 90° C.

The operation of one electrolytic cell in the electrolyzing plant was stopped by the jumping switch (knife switch: electric resistance of 0.01Ω) as shown in FIG. 3 to shortcircuit the electrolytic cell.

As the method of Example 1, before the actuation of the jumping switch, an aqueous solution of NaClO, an aqueous solution of NaOH or an aqueous solution of HClO was continuously added to give each concentration of $ClO^-$ in each anolyte as shown in Table 3 and the jumping switch was actuated. The results are shown in Table 3 together with data for non-addition.

TABLE 3

| No. | Method | Anolyte at shortcircuit: Conc. of $ClO^-$ (g./l.) | Anolyte at shortcircuit: pH | Potential of anode at shortcircuit (V) vs S.C.E. | Reduction |
|---|---|---|---|---|---|
| 1 | 4% NaClO aq. feed | 1.0–1.8 | 4.3–4.5 | −0.2−−0.35 | None |
| 2 | 9% NaClO aq. feed | 3.1–3.6 | 4.8–5.1 | 0−−0.1 | " |
| 3 | 13% NaClO aq. feed | 5.7–6.5 | 5.2–5.5 | +0.1−−0.1 | " |
| 4 | 10% NaOH aq. feed | 1.2–1.9 | 9.8–10.8 | −0.3−−0.35 | " |
| 5 | None | 0.5–0.7 | 3.8–4.2 | −0.5−−0.65 | Reduction |

We claim:

1. The method of preventing deterioration of a palladium oxide type anode in the anolyte of a diaphragm type electrolytic cell for electrolysis of an alkali metal chloride comprising adding to said anolyte a compound generating hypochlorite ion during shortcircuit state, the concentration of said hypochlorite ion being higher than 1.0 g./l., whereby the concentration of hypochlorite ion in the anolyte yields an anode potential higher than the reduction potential of palladium oxide.

2. The method according to claim 1 wherein said compound generating hypochlorite ion compound is hypochlorous acid, an alkali metal hypochlorite, an alkaline earth metal hypochlorite, an alkali metal hydroxide or an alkaline earth metal hydroxide.

3. The method according to claim 1 wherein said palladium oxide type anode is an electrode having a valve metal substrate coated with a surface layer comprising palladium oxide.

4. The method according to claim 3 wherein the content of palladium oxide in said surface layer is more than 5 mol %.

5. The method according to claim 3 or 4 wherein said surface layer comprises 5 to 99 mol % of palladium oxide and 1 to 95 mol % of platinum group metal.

6. The method according to claim 5 wherein said platinum group metal is platinum.

7. The method according to claim 1 wherein said diaphragm type electrolytic cell for electrolysis of an alkali metal chloride is a diaphragm electrolytic cell using a porous diaphragm.

8. The method according to claim 1 wherein said diaphragm type electrolytic cell for electrolysis of an alkali metal chloride is an ion exchange membrane electrolytic cell using a cation exchange membrane.

9. The method according to claim 1 wherein said alkali metal chloride is sodium chloride or potassium chloride.

* * * * *